US010720318B2

(12) United States Patent
Kou

(10) Patent No.: US 10,720,318 B2
(45) Date of Patent: Jul. 21, 2020

(54) MASS ANALYSIS APPARATUS AND MASS ANALYSIS METHOD

(71) Applicant: JEOL Ltd., Tokyo (JP)

(72) Inventor: Junkei Kou, Tokyo (JP)

(73) Assignee: JEOL Ltd., Tokyo (JP)

( * ) Notice: Subject to any disclaimer, the term of this patent is extended or adjusted under 35 U.S.C. 154(b) by 0 days.

(21) Appl. No.: 16/352,044

(22) Filed: Mar. 13, 2019

(65) Prior Publication Data

US 2019/0287784 A1 Sep. 19, 2019

(30) Foreign Application Priority Data

Mar. 19, 2018 (JP) ..... 2018-051557

(51) Int. Cl.
*H01J 49/00* (2006.01)
*H01J 49/42* (2006.01)

(52) U.S. Cl.
CPC ..... *H01J 49/4215* (2013.01); *H01J 49/004* (2013.01); *H01J 49/0027* (2013.01); *H01J 49/0031* (2013.01); *H01J 49/422* (2013.01)

(58) Field of Classification Search
CPC ..... H01J 49/00; H01J 49/02; H01J 49/4215; H01J 49/0481; H01J 49/0045; H01J 49/005; H01J 49/0054; H01J 49/0027; H01J 49/0031
USPC ..... 250/281, 282, 288
See application file for complete search history.

(56) References Cited

U.S. PATENT DOCUMENTS

| | | | | |
|---|---|---|---|---|
| 6,285,027 | B1 | 9/2001 | Chernushevich et al. | |
| 2011/0291003 | A1 | 12/2011 | Kou | |
| 2012/0160998 | A1 | 6/2012 | Kou | |
| 2014/0138539 | A1* | 5/2014 | Kou | H01J 9/427 250/283 |
| 2016/0209378 | A1 | 7/2016 | Kobayashi et al. | |
| 2017/0328874 | A1 | 11/2017 | Yamamoto et al. | |

FOREIGN PATENT DOCUMENTS

| | | | |
|---|---|---|---|
| JP | 1055777 | A | 2/1998 |
| JP | 2010127714 | A | 6/2010 |
| JP | 2011249069 | A | 12/2011 |
| JP | 2012138270 | A | 7/2012 |
| JP | 201459964 | A | 4/2014 |

OTHER PUBLICATIONS

Extended European Search Report issued in EP 19162365.1 dated Aug. 19, 2019.

* cited by examiner

*Primary Examiner* — Jason L McCormack
(74) *Attorney, Agent, or Firm* — The Webb Law Firm

(57) ABSTRACT

When a first scheme (transition observation time optimization scheme) is selected, a computation unit computes an actual transition observation time as a time of an integer multiple of a storage-ejection time of a collision cell within a frame of a transition observation time. When a second scheme (storage-ejection time optimization scheme) is selected, the computation unit divides the transition observation time by a maximum storage-ejection time to determine a number of repetitions of a storing-ejecting operation of the collision cell, and determines a storage-ejection time based thereon.

5 Claims, 12 Drawing Sheets

| MODE | STORAGE TIME (s) | EJECTION TIME (s) |
|---|---|---|
| HIGH-SENSITIVITY MODE | **** | **** |
| HIGH-SPEED MODE | **** | **** |

84

| STORAGE TIME | SETTING TEMPERATURE |
|---|---|
| LESS THAN k1 | GREATER THAN OR EQUAL TO K1 |
| GREATER THAN OR EQUAL TO k2 AND LESS THAN k3 | GREATER THAN OR EQUAL TO k2 |
| GREATER THAN OR EQUAL TO k4 AND LESS THAN k5 | GREATER THAN OR EQUAL TO k3 |
| GREATER THAN OR EQUAL TO k5 | GREATER THAN OR EQUAL TO k4 |

FIG. 13

MASS ANALYSIS APPARATUS AND MASS ANALYSIS METHOD

CROSS-REFERENCE TO RELATED APPLICATION

This application claims priority to Japanese Patent Application No. 2018-051557 filed Mar. 19, 2018, the disclosure of which is hereby incorporated by reference in its entirety.

BACKGROUND OF THE INVENTION

Field of the Invention

The present disclosure relates to a mass analysis apparatus and a mass analysis method, and in particular to a mass analysis apparatus having a collision cell, and to a mass analysis method which uses the mass analysis apparatus.

Description of Related Art

Various apparatuses are commercialized as mass analysis apparatuses. Among these apparatuses, a tandem-type mass analysis apparatus generally comprises an ion source, a first mass analyzer, a collision cell, a second mass analyzer, and a detector.

Specific examples of these elements will now be described. The first mass analyzer is an element which selects, as first target ions, precursor ions having a particular mass-to-charge ratio (m/z) from among ions generated by the ion source. The first mass analyzer is formed as a first quadrupole apparatus. The collision cell is an element in which the precursor ions are caused to collide with a collision-induced dissociation gas (CID gas) to cause cleavage or dissociation of the precursor ions, and to thereby generate product ions (which are also called "fragment ions") from the precursor ions. The collision cell is formed as a second quadrupole apparatus having a quadrupole ion guide. The second mass analyzer is an element which selects, as second target ions, particular product ions having a particular mass-to-charge ratio (m/z) from among the product ions generated in the collision cell. The second mass analyzer is formed as a third quadrupole apparatus. The detector is formed from an electron multiplier. In some cases, a conversion dynode may be placed near the electron multiplier.

When mass analysis is executed for a sample, for example, a gas chromatograph is connected upstream of the tandem-type mass analysis apparatus. For a plurality of compounds sequentially sent from the gas chromatograph, multiple reaction monitoring (MRM) is executed in the tandem-type mass analysis apparatus. The multiple reaction monitoring is also called selected reaction monitoring (SRM).

In the MRM, in general, a cycle measurement; that is, circulatory measurement, is executed for each compound. In the cycle measurement, a cycle unit is repeatedly executed. The cycle unit is formed from a plurality of transitions (or a plurality of transition observation times) arranged on a time axis. One transition corresponds to a combination of a selected precursor ion and a selected product ion. As a result of the cycle measurement for each compound, a plurality of detection data arranged with an interval of the cycle measurement period for each transition are obtained. The transition is also called a channel, and the transition observation time is also called a channel time. The cycle measurement for each compound is also called a group.

In tandem-type mass analysis apparatuses disclosed in JP 2010-127714 A, JP 2011-249069 A, and JP 2012-138270 A, the collision cell periodically executes a storing operation and an ejecting operation, in order to improve sensitivity.

When the multiple reaction monitoring (MRM) is executed using a mass analysis apparatus having a storage-ejection type collision cell which periodically executes the storing operation and the ejecting operation, the transition observation time is directly or indirectly designated by the user for each transition. Meanwhile, a basic time unit in the collision cell is a storage-ejection time which is a sum of a storage time and an ejection time. In the related art, the transition observation time and the storage-ejection time are not correlated to each other in setting an operation condition of the mass analysis apparatus. In other words, there has been no scheme to optimize one of the transition observation time and the storage-ejection time with respect to the other. Because of this, for example, there has been a problem in that a wasteful idle time may be caused during a sample measurement, or a problem in that a high sensitivity cannot be achieved under certain conditions.

An advantage of the present disclosure lies in enabling correlation of the transition observation time and the storage-ejection time with each other when the multiple reaction monitoring is executed using the mass analysis apparatus having the storage-ejection type collision cell.

SUMMARY OF THE INVENTION (1) According to one aspect of the present disclosure, there is provided a mass analysis apparatus comprising: a measurement unit that includes a first mass analyzer which selects first target ions from among precursor ions, a collision cell which generates product ions from the first target ions and which stores and ejects the product ions, a second mass analyzer which selects second target ions from among the product ions, and a detector which detects the second target ions; an inputter for designating a transition observation time for each of transitions which are combinations of the first target ions and the second target ions; a computation unit that computes, for each of the transitions, an actual transition observation time as a time of an integer multiple of a storage-ejection time which is a sum of a storage time and an ejection time of the collision cell such that a storing-ejecting operation of the collision cell is repeated the largest number of times within a frame of the transition observation time; and a controller that controls an operation of the measurement unit based on the storage time and the ejection time of the collision cell, and the actual transition observation time for each of the transitions.

The above-described structure optimizes the transition observation time according to the storage-ejection time of the collision cell. This scheme will hereinafter be called a transition observation time optimization scheme. Specifically, the actual transition observation time is computed as a time of an integer multiple of the storage-ejection time of the collision cell within the frame of the designated transition observation time. With this configuration, occurrence of a wasteful idle time in the collision cell is prevented. Because the actual transition observation time is determined to further cause the storing-ejecting operation of the collision cell to be repeated the largest number of times within the frame of the designated transition observation time, measurement efficiency can be improved while respecting the user's designation.

According to another aspect of the present disclosure, the transition observation time is directly or indirectly designated by a user. The storage time and the ejection time of the collision cell may be constant over one sample measurement. Alternatively, one or both of the storage time and the ejection time may be changed in units of transitions or in units of compound measurements.

According to another aspect of the present disclosure, the computation unit: computes a quotient by dividing the transition observation time by the storage-ejection time; computes a number of repetitions of the storing-ejecting operation by truncating fractions of the quotient; and computes the actual transition observation time by multiplying the storage-ejection time by the number of repetitions. This structure attempts to reduce the wasteful idle time by truncating a remainder which occurs as a result of the division.

According to another aspect of the present disclosure, a plurality of storage times and a plurality of ejection times corresponding to a plurality of modes are managed, a particular mode is selected from among the plurality of modes using the inputter, and the computation unit computes the actual transition observation time based on the storage time and the ejection time corresponding to the particular mode. For example, as the plurality of modes, a high-sensitivity mode and a high-speed mode may be prepared, and the storage time and the ejection time may be determined for each mode. Generally, in the high-sensitivity mode, a longer storage time is set as compared to the high-speed mode. The ejection time may be the same for both modes.

According to another aspect of the present disclosure, the mass analysis apparatus further comprises a display that displays the actual transition observation time for each of the transitions or displays an actual cycle time which is a sum of a plurality of the actual transition observation times corresponding to a plurality of the transitions. According to this structure, it becomes possible for the user to check the actual transition observation time or the actual cycle time which is automatically set. The actual cycle time corresponds to a sampling period for each of the transitions.

According to another aspect of the present disclosure, there is provided a mass analysis method comprising: selecting, in a first mass analyzer, first target ions from among precursor ions; generating, in a collision cell, product ions from the first target ions, and storing and ejecting the product ions; selecting, in a second mass analyzer, second target ions from among the product ions; receiving a designation of a transition observation time for each of transitions which are combinations of the first target ions and the second target ions; computing, for each of the transitions, an actual transition observation time as a time of an integer multiple of a storage-ejection time which is a sum of a storage time and an ejection time of the collision cell such that a storing-ejecting operation of the collision cell is repeated the largest number of times within a frame of the transition observation time; and controlling operations of the first mass analyzer, the collision cell, and the second mass analyzer based on the storage time and the ejection time of the collision cell, and the actual transition observation time for each of the transitions.

(2) According to another aspect of the present disclosure, there is provided a mass analysis apparatus comprising: a measurement unit that includes a first mass analyzer which selects first target ions from among precursor ions, a collision cell which generates product ions from the first target ions and which stores and ejects the product ions, a second mass analyzer which selects second target ions from among the product ions, and a detector which detects the second target ions; and a computation unit that executes a computation for controlling an operation of the measurement unit, wherein a transition observation time is determined for each of transitions which are combinations of the first target ions and the second target ions, a maximum storage-ejection time is determined as a sum of a maximum storage time and an ejection time of the collision cell, the computation unit computes, for each of the transitions, a number of repetitions of a storing-ejecting operation of the collision cell in the transition observation time and a storage-ejection time of the collision cell based on the transition observation time and the maximum storage-ejection time of the collision cell, and the operation of the measurement unit is controlled based on the number of repetitions of the storing-ejecting operation of the collision cell and the storage-ejection time of the collision cell.

The above-described structure optimizes the storage-ejection time of the collision cell according to the transition observation time. This scheme will hereinafter be referred to as a storage-ejection time optimization scheme. Specifically, a plurality of storage-ejection times are determined by a uniform division of the transition observation time. With this configuration, occurrence of the wasteful idle time in the transition observation time is prevented. In addition, because the storage-ejection time (in particular, the storage time) can be set to be close to the maximum storage-ejection time (in particular, the maximum storage time), the sensitivity can be improved.

According to the above-described structure, when the transition observation time is individually determined for each transition, the storage-ejection time can be determined for each transition. Alternatively, the storage-ejection time may be determined in units of compound measurements or other units.

According to another aspect of the present disclosure, the computation unit: computes a quotient by dividing the transition observation time by the maximum storage-ejection time; computes the number of repetitions by rounding up fractions of the quotient; and computes the storage-ejection time by dividing the transition observation time by the number of repetitions. This process sets the value of (quotient+1) as the number of repetitions, and uniformly divides the transition observation time by (quotient+1).

According to another aspect of the present disclosure, a cycle including a plurality of the transitions is repeatedly executed, and the computation unit computes a plurality of storage times from a plurality of storage-ejection times computed for a plurality of the transitions of the cycle, and sets the shortest storage time among the plurality of the storage times as a common storage time for the plurality of the transitions. When the storage time is individually set for each transition, the control inevitably becomes complex. In comparison to such a configuration, according to the above-described structure, the control can be simplified.

According to another aspect of the present disclosure, there is provided a mass analysis method comprising: selecting, in a first mass analyzer, first target ions from among precursor ions; generating, in a collision cell, product ions from the first target ions, and storing and ejecting the product ions; selecting, in a second mass analyzer, second target ions from among the product ions; and executing a computation for controlling an operation of a measurement unit which includes the first mass analyzer, the collision cell, and the second mass analyzer, wherein a transition observation time is determined for each of transitions which are combinations of the first target ions and the second target ions, a maximum storage-ejection time is determined as a sum of a maximum storage time and an ejection time of the collision cell, in the executing the computation for controlling the operation of the measurement unit, for each of the transitions, a number of repetitions of a storing-ejecting operation of the collision cell in the transition observation time and a storage-ejection time of the collision cell are computed based on the transition observation time and the maximum storage-ejection time of the collision cell, and the operation of the measurement unit is controlled based on the number of repetitions of the storing-ejecting operation of the collision cell, and the storage-ejection time of the collision cell.

(3) In both cases in which the transition observation time optimization scheme is employed and in which the storage-ejection time optimization scheme is employed, a rational relationship can be constructed between the transition observation time and the storage-ejection time in the control of the operation of the measurement unit.

BRIEF DESCRIPTION OF THE DRAWINGS

Embodiment(s) of the present disclosure will be described by reference to the following figures, wherein:

FIG. 13 is a diagram showing a temperature management table.

DESCRIPTION OF THE INVENTION

An embodiment of the present disclosure will now be described with reference to the drawings.

Figure 1:
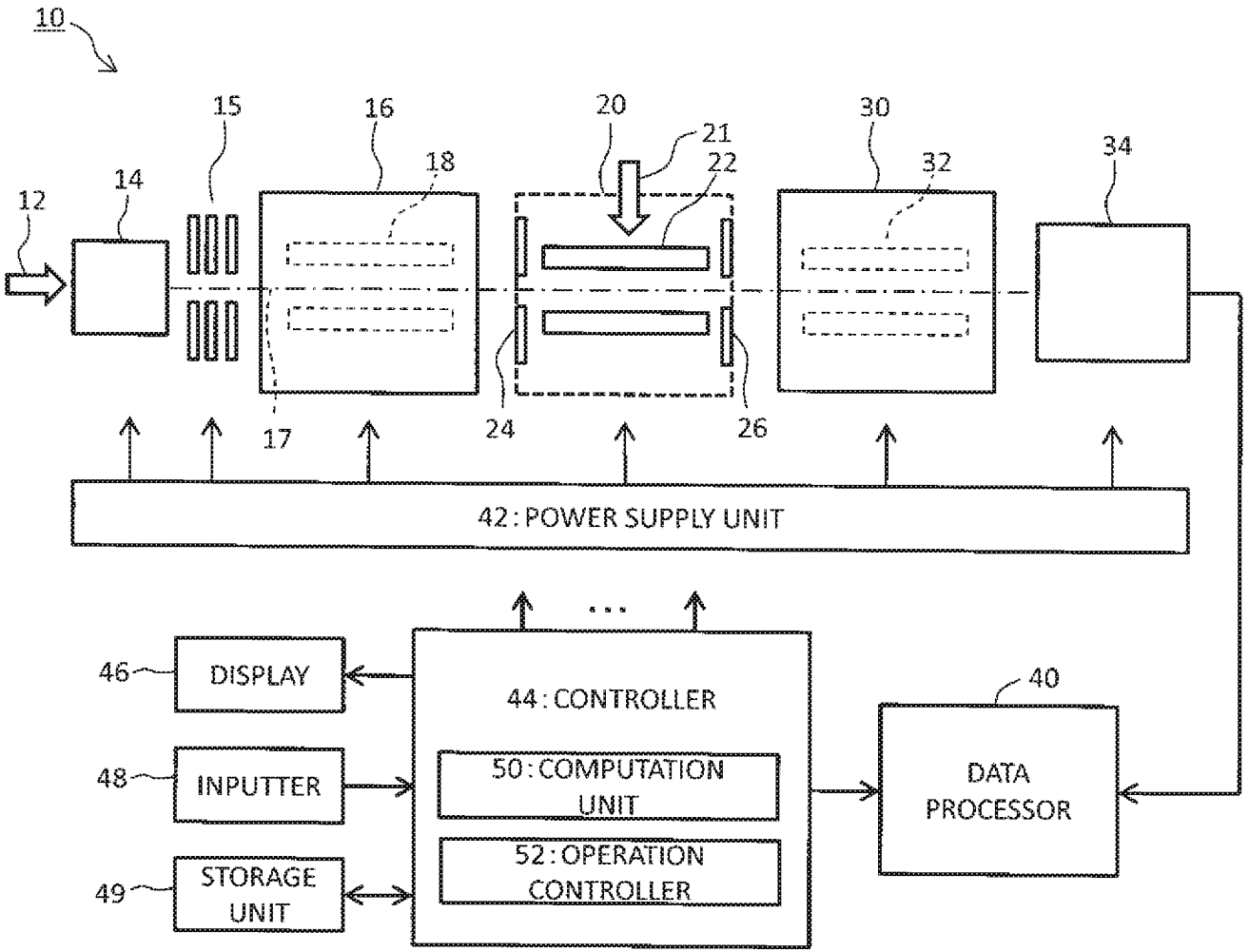
FIG. 1 is a block diagram showing a mass analysis apparatus according to an embodiment of the present disclosure.

FIG. 1 shows a mass analysis apparatus according to the embodiment of the present disclosure. The mass analysis apparatus is a storage-ejection type, tandem type mass analysis apparatus, and is specifically a storage-ejection type, triple quadrupole mass analysis apparatus. The mass analysis apparatus shown in FIG. 1 can execute multiple reaction monitoring (MRM).

The mass analysis apparatus according to the embodiment is provided with a plurality of schemes for executing the MRM without causing a wasteful idle time. The plurality of schemes are specifically a transition observation time optimization scheme (first scheme) and a storage-ejection time optimization scheme (second scheme). An operation condition of the mass analysis apparatus is determined according to a scheme selected from these two schemes. First, structures and operations common to both schemes will be described with reference to FIGS. 1 to 4. Then, the first scheme will be described with reference to FIGS. 5 to 8, and the second scheme will be described with reference to FIGS. 9 to 11.

(1) Common Structures and Operations

Referring to FIG. 1, in the embodiment, a measurement unit 10 comprises an ion source 14, a lens 15, a first mass analyzer 16, a collision cell 20, a second mass analyzer 30, and a detector 34. These elements will be described below in sequence.

As shown by reference numeral 12, for example, a plurality of compounds which are timewise separated in a sample introduction apparatus such as a gas chromatograph are sequentially introduced into the ion source 14. The ion source 14 is a device which ionizes the introduced compound. As a method of ionization, electronic ionization (EI), chemical ionization (CI), matrix-assisted laser desorption/ionization (MALDI), electrospray ionization (ESI), and the like are known. The lens 15 having an aperture electrode or the like is provided downstream of the ion source 14. In FIG. 1, reference numeral 17 shows an ion trajectory.

The first mass analyzer 16 is a device which selects, using a difference in a mass-to-charge ratio, first target ions to be sent to the collision cell 20 from among precursor ions (a group of precursor ions) derived from the compounds and generated by the ion source. The precursor ions are also called parent ions. In the embodiment, the first mass analyzer 16 is a quadrupole-type mass analyzer having four poles (electrodes) 18. In a quadrupole-type device, high-frequency signals having the same amplitude and the same frequency are applied to the poles to satisfy a predetermined condition. The predetermined condition is a condition that high-frequency signals of the same phase are applied to two poles in a diagonal relationship, and high-frequency signals of opposite phases are applied to two adjacent poles. In addition to the high-frequency signal, a direct current signal and an offset signal are applied to each pole. A sign of the direct current signal is determined according to the above-described predetermined condition. The offset signal is common to four high-frequency signals. For example, m/z to be selected is changed by changing a level of the direct current signal. The offset signal determines an offset potential. Alternatively, as the first mass analyzer 16, a mass analyzer of another type having an ion selection function may be provided. The collision cell 20 is provided downstream of the first mass analyzer 16.

The collision cell 20 is a device which causes the precursor ions which are the first target ions to collide with a collision gas 21 introduced from an outside, to cause cleavage or dissociation of the precursor ions, and to consequently generate product ions (which are also called a group of product ions). The product ions are also called fragment ions. As the collision gas, for example, helium gas, nitrogen gas, argon gas, or the like is used. In the embodiment, the collision cell is a quadrupole-type device having an ion guide 22 made of four poles (electrodes).

The collision cell 20 of the embodiment alternately and repeatedly executes a storing operation and an ejecting operation. In the storing period, ions are stored in the collision cell 20, and in the ejecting period which follows the storing period, the stored ions are output to the downstream device as an ion pulse. The collision cell 20 has an entrance electrode 24 and an exit electrode 26, and the storing operation and the ejecting operation are switched by a control of potentials of the entrance electrode 24 and the exit electrode 26. Specifically, for the exit electrode 26, a voltage pulse is periodically applied. When the potential of the exit electrode 26 becomes higher than the potential of the ion source 14, the exit electrode 26 is set to a closed state. When the potential of the exit electrode 26 becomes lower than an axial potential (offset potential) of the ion guide 22, the exit electrode 26 is set to an open state.

Alternatively, a voltage pulse may be periodically applied to the entrance electrode 24. By setting the entrance electrode 24 in the closed state during the ion ejecting period, entrance of ions into the collision cell can be prevented. During the ion storing period, the entrance electrode 24 is set to an open state. When a potential of the entrance electrode 24 becomes higher than the potential of the ion source 14, the entrance electrode 24 is set to the closed state. When the potential of the entrance electrode 24 becomes lower than the potential of the ion source 14, the entrance electrode 24 is set to the open state. The second mass analyzer 30 is provided downstream of the collision cell 20.

Similar to the first mass analyzer 16, the second mass analyzer 30 is a device which selects, using the difference of the mass-to-charge ratio, second target ions which are detection targets, from among product ions generated in the collision cell 20. In the embodiment, the second mass analyzer 30 is formed from a quadrupole-type mass analyzer having four poles (electrodes) 32. Alternatively, as the second mass analyzer 30, a mass analyzer of another type having an ion selection function may be provided. The detector 34 is provided downstream of the second mass analyzer 30.

In the embodiment, the detector 34 has a conversion dynode and an electron multiplier. The second target ions are captured by the conversion dynode, and electrons are generated from the second target ions. The electrons are detected and multiplied by the electron multiplier. With this process, a detection signal is generated. Alternatively, a structure other than that described above may be employed as the detector 34.

A data processor 40 is a module which comprises electric circuits such as an amplifier and an A/D converter, and a processor, and which processes detected data. A controller 44 controls operations of various elements including the measurement unit 10, and comprises a CPU and an operation program. The controller 44 controls the storing operation and the ejecting operation of the collision cell 20 through control of a power supply unit 42. Alternatively, the controller 44 may be formed from a plurality of processors. Alternatively, the controller 44 may be formed from another control device which operates according to a program.

A plurality of representative functions of the controller 44 are represented in FIG. 1 by a plurality of blocks. The controller 44 comprises a computation unit 50 and an operation controller 52. The operation controller 52 executes a series of controls for measuring the plurality of compounds which are sequentially introduced, in the multiple reaction monitoring (MRM). The computation unit 50 is a module which executes a computation of parameters which are necessary, prior to the execution of the multiple reaction monitoring (MRM). In particular, the computation unit 50 has functions to compute an actual transition observation time in the first scheme (transition observation time optimization scheme), and to compute a storage-ejection time in the second scheme (storage-ejection time optimization scheme). The data processor 40 and the controller 44 may be formed from a PC or other information processor apparatuses.

A display 46, an inputter 48, and a storage unit 49 are connected to the controller 44. The inputter 48 is formed from a keyboard, a pointing device, or the like, and is a means for the user to input or designate various measurement conditions, and to select an operation mode and the scheme, in the MRM. The display 46 is formed from an LCD or other display devices. Various measurement conditions are displayed on the display 46 prior to the MRM, and a measurement result is also displayed. The storage unit 49 is formed from a storage device such as a semiconductor memory and a hard disk drive, and various types of information necessary for the operation control are stored therein. In the storage unit 49, the measurement condition for each compound or an operation sequence of the measurement unit 10 is stored. The mass analysis apparatus of the embodiment may operate in an operation mode other than the MRM.

Figure 2:
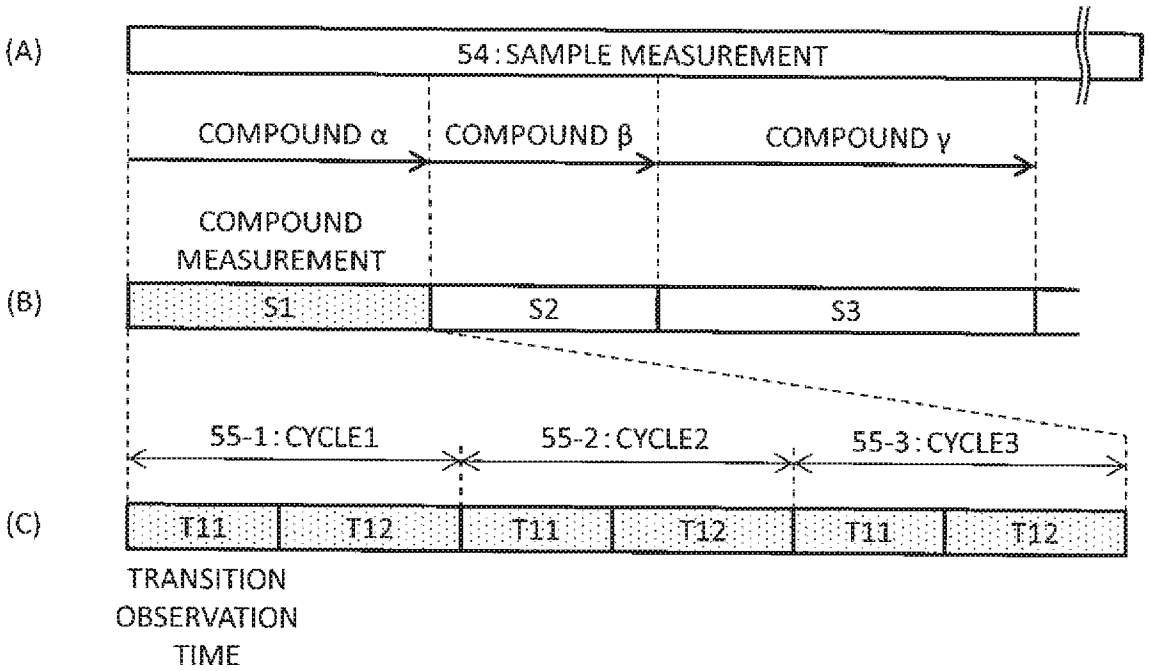
FIG. 2 is a diagram showing measurement of a sample including a plurality of compound measurements.

FIG. 2 shows in (A) a sample measurement 54, which corresponds to an entirety of the measurement sequence. The sample is separated into a plurality of compounds on a time axis by the sample introduction apparatus, and the plurality of compounds are sequentially introduced into the measurement unit. FIG. 2 exemplifies in (B) compound measurements S1, S2, and S3 for compounds α, β, and γ. For example, an introduction time of one sample is a few minutes to a few tens of minutes. A period in which one compound continues to appear depends on the sample introduction apparatus. For example, in the case of the chromatograph, the period is about a few seconds. A time period obtained by adding margins before and after this period is a compound measurement time, which is, for example, a few tens of seconds.

In each of the compound measurements S1, S2, and S3, a cycle measurement (circulatory measurement) is executed. For example, with reference to the compound measurement S1, the compound measurement S1 includes three cycles 55-1~55-3 in the exemplified configuration, and each of the cycles 55-1~55-3 is formed from two transition observation times T11 and T12. In other words, two transition observation times T11 and T12 arranged on the time axis form a cycle unit, and the cycle unit is repeatedly executed.

A transition corresponds to a combination of a first target ion (a precursor ion selected by the first mass analyzer) and a second target ion (a product ion selected by the second mass analyzer). The transition is also called a channel. The transition observation time is an observation time for the transition, and is also called a channel time.

For each transition, a transition observation time is directly or indirectly designated by the user. For example, for each transition, the transition observation time is directly designated as a numerical value by the user, or the transition observation time is indirectly designated by dividing a cycle time designated by the user by a number of transitions forming the cycle unit. In the compound measurements S1, S2, and S3, for each transition, a plurality of detection data arranged with an interval of the cycle time are obtained. In other words, a plurality of detection data are obtained as a sampling result of a peak waveform for the product ions. Each detection data is an accumulated value of a plurality of ion intensities intermittently detected within the transition observation time.

By increasing the number of transitions for one compound measurement, it becomes possible to more accurately identify the compound. On the other hand, in one compound measurement, by shortening the cycle time, a time resolution can be improved and a number of samples can be increased. When the transition observation time is increased, the sensitivity can be improved. It is desirable that the number of transitions, the cycle time, the transition observation time for each transition, and the storage-ejection time are determined in comprehensive consideration of a sample to be measured, an objective of measurement, a necessary sensitivity, and other circumstances. However, making the user execute an operation to correlate and optimize the transition observation time and the storage-ejection time would impose a large burden on the user. Thus, in the embodiment, the first scheme and the second scheme are prepared, and are selectively employed.

Figure 3:
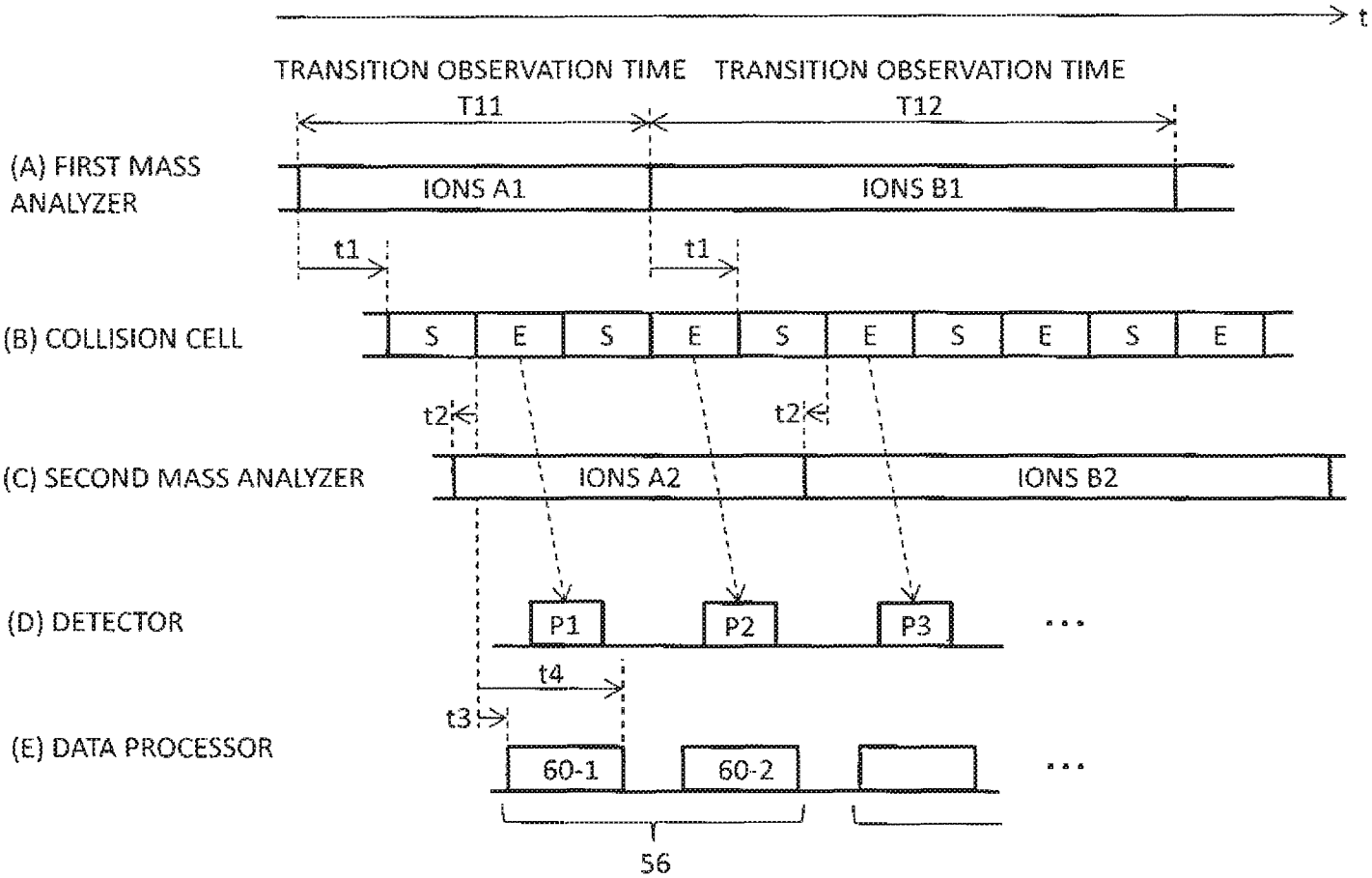
FIG. 3 is a timing chart showing an operation of a mass analysis system.

FIG. 3 shows an example operation in the MRM. A horizontal axis shows a time axis. (A) shows an operation of the first mass analyzer, and (B) shows an operation of the collision cell. Specifically, a storing-ejecting operation which is repeated at a short period is shown. In FIG. 3, "S" shows a storing operation or a storage period, and "E" shows an ejecting operation or an ejection period. In reality, in general, the storage period is longer than the ejection period. However, in FIG. 3, showing of such a relationship in magnitude is omitted. (C) shows an operation of the second mass analyzer, (D) shows an operation of the detector, and (E) shows an operation of the data processor. According to the movements of the ions in the mass analysis apparatus, a delay in time is caused from (A) to (E).

In the example configuration shown in FIG. 3, in the transition observation time T11, precursor ions A1 are selected in the first mass analyzer, and product ions A2 are selected in the second mass analyzer. In the transition observation time T12, precursor ions B1 are selected in the first mass analyzer, and product ions B2 are selected in the second mass analyzer. In each of the transition observation times T11 and T12, the collision cell repeats the storing-ejecting operation. An ion pulse is generated during the ejecting operation, and is detected by the detector (refer to P1, P2, and P3). Each detection signal is read into the data processor (refer to 60-1 and 60-2). For each transition, a plurality of detection signals are obtained, and, by accumulation 56 thereof, detection data connected to the time are obtained.

The timing relationship will now be described in more detail. In the transition observation time T11, in the collision cell, the storing-ejecting operation is started with a delay of t1 from a start timing of the transition observation time T11. Similarly, in the transition observation time T12, in the collision cell, the storing-ejecting operation is started with a delay of t1 from a start timing of the transition observation time T12. In the transition observation time T11, selection of the product ions A2 in the second mass analyzer is started at a time which is a time t2 prior to a timing when ejection of the product ions A2 (more accurately, product ions including the product ions A2) is started in the collision cell. During passage of the product ions A2, the second mass analyzer continues to select the product ions A2. Similarly, in the transition observation time T12, the selection of the product ions B2 in the second mass analyzer is started at a time which is a time t2 prior to a timing when ejection of the product ions B2 (more accurately, product ions including the product ions B2) is started in the collision cell. During passage of the product ions B2, the second mass analyzer continues to select the product ions B2. In the transition observation time T11, the data processor starts reading with a delay of t3 from a timing of start of ejection for each ejection of the product ions A2 (more accurately, product ions including the product ions A2), and completes the reading with a delay of t4 from the timing of start of ejection. In the transition observation time T12 also, the data processor executes a similar operation. Here, t1, t2, t3, and t4 do not depend on the storage time.

Figure 4:
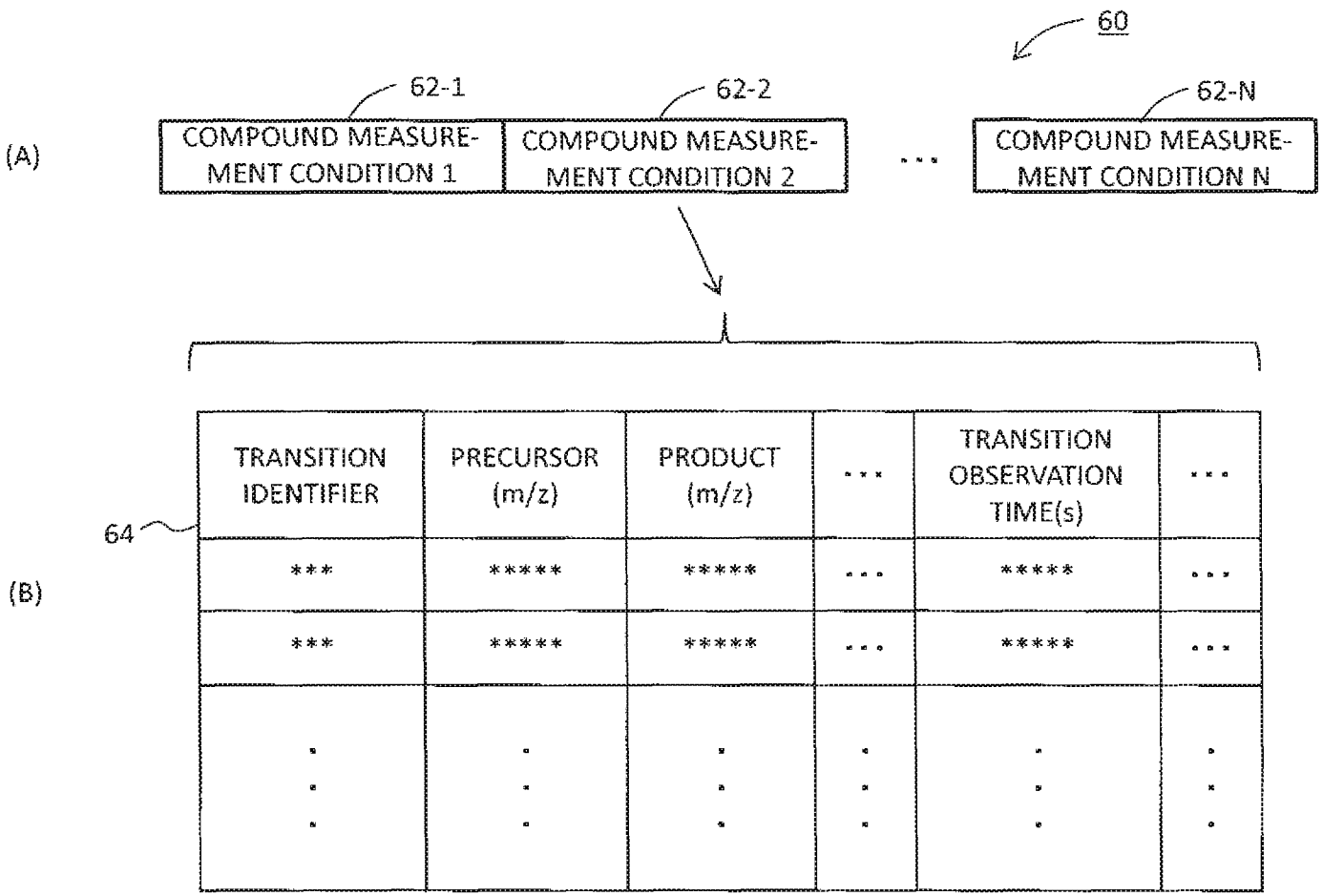
FIG. 4 is a diagram showing a sample measurement condition.

FIG. 4 shows a sample measurement condition 60. The sample measurement condition 60 is a condition applied in the sample measurement shown in FIG. 3. In other words, the sample measurement condition 60 is a condition for determining a measurement sequence which defines an operation of the measurement unit. The sample measurement condition 60 is determined for each sample to be measured.

Specifically, the sample measurement condition 60 includes a plurality of compound measurement conditions 62-1~62-N, which are arranged in a time sequential order. Each of the compound measurement conditions 62-1~62-N includes a plurality of sets of parameters 64 corresponding to a plurality of transitions. In the example structure shown in FIG. 4, each parameter set 64 includes a transition identifier, m/z of the precursor ion, m/z of the product ion, and the transition observation time. As described above, the transition observation time is directly or indirectly designated by the user.

When the above-described first scheme (transition observation time optimization scheme) is employed, assuming that the storage-ejection time of the collision cell is set to a constant value over the sample measurement as a whole, the transition observation time is optimized as an actual transition observation time within a frame of the transition observation time designated by the user for each transition. The operation of the measurement unit is controlled based on the actual transition observation time in place of the transition observation time. When the above-described second scheme (storage-ejection time optimization scheme) is employed, the storage-ejection time is optimized based on the transition observation time in units of transitions or in units of compound measurements.

(2) First Scheme (Transition Observation Time Optimization Scheme)

Figure 5:
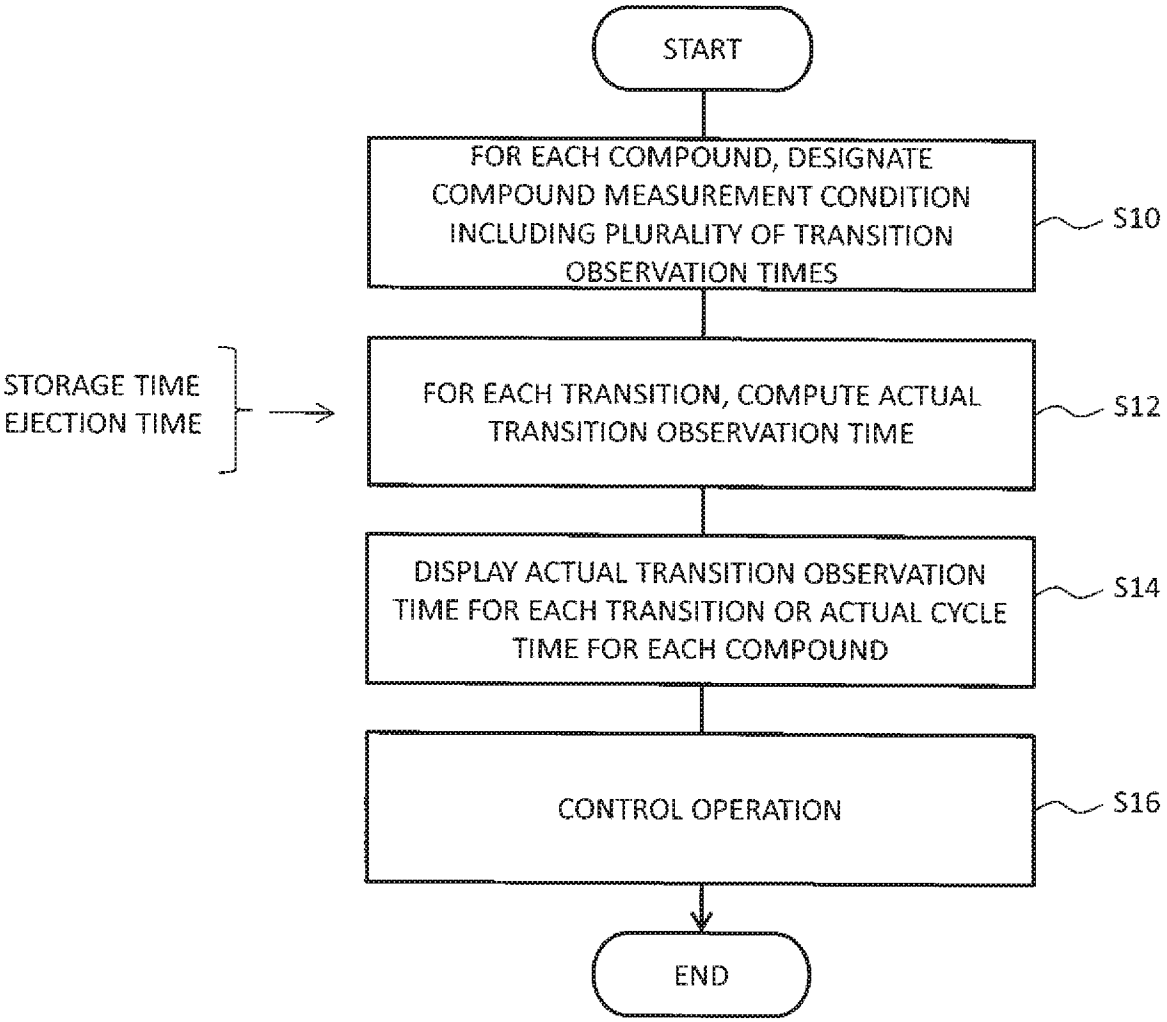
FIG. 5 is a flowchart showing a transition observation time optimization scheme.

FIG. 5 shows as a flowchart an example operation (example control) according to the first scheme. In S10, a compound measurement condition is designated by the user for each compound. Specifically, the compound measurement condition for each compound is received at the controller. Alternatively, in this process, a preset compound measurement condition may be selected. Each compound measurement condition includes a plurality of transition observation times. In S12, for each transition, the actual transition observation time to be used in place of the transition observation time is computed. In this process, the storage time and the ejection time of the collision cell are referred to. In S14, the actual transition observation time for each transition or an actual cycle time for each compound is displayed on a screen. The actual cycle time is a sum of a plurality of actual transition observation times for the plurality of transitions of the cycle, and corresponds to a sampling period. In S16, the operation of the measurement unit is controlled according to the plurality of compound measurement conditions including the plurality of parameters computed in the manner described above.

Figures 6, 7:
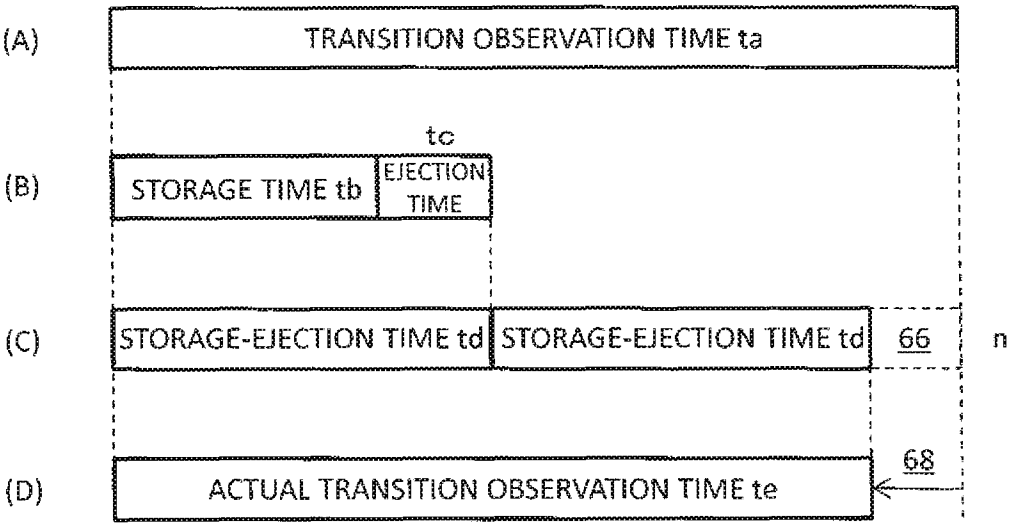
FIG. 6 is a diagram showing a high-sensitivity mode and a high-speed mode.
FIG. 7 is a diagram for explaining computation of an actual transition observation time.

As shown in FIG. 6, in the embodiment, two combinations are prepared as combinations of the storage time and the ejection time. A high-sensitivity mode is a mode in which measurement prioritized in the sensitivity is executed. A high-speed mode is a mode in which measurement prioritized in the sampling speed is executed. For example, when a quantitative measurement such as a multi-component analysis including a few hundreds of compositions is to be executed, the high-speed mode is selected.

When the user selects the high-sensitivity mode, a first storage time is automatically selected as the storage time, and a first ejection time is automatically selected as the ejection time. On the other hand, when the user selects the high-speed mode, a second storage time is automatically selected as the storage time, and a second ejection time is selected as the ejection time. The first storage time is, for example, about 10 times the second storage time. For example, the first storage time is set in a range of 6.0~14.0 ms, and the second storage time is set in a range of 0.6~1.2 ms. The first ejection time and the second ejection time are, for example, the same, and are set in, for example, a range of 0.1~0.3 ms. In the first scheme, the selected storage time and the selected ejection time are maintained over one sample measurement. Alternatively, the storage time and the ejection time may be selected or designated by the user for each compound measurement or for each transition.

A signal detected between ion pulses which are output from the collision cell is noise. By detecting the ion pulse at the detector and not detecting the noise in synchronization with the storing-ejecting operation, the SN ratio can be improved. As the storage time is set longer, the ion pulse interval is set longer, and the noise suppression advantage can be increased. Therefore, a high sensitivity can be achieved by elongating the storage time in a range where ion loss in the collision cell can be ignored. In contrast, when the shortening of the sampling period is to be prioritized over the sensitivity, the storage time is desirably shortened. The first storage time and the second storage time described above satisfy these needs.

The time required for the ejection of the ions from the collision cell (ejection time) depends on the ion having the largest mass-to-charge ratio in the collision cell. That is, the ejection time depends on the precursor ion selected in the first mass analyzer. Thus, ideally, the ejection time is switched for each precursor ion introduced into the collision cell. However, such a configuration would complicate the control. From the viewpoint of simplifying the control, the ejection time is desirably determined as a fixed value so that all ions are ejected from the collision cell regardless of which precursor ions are selected and regardless of the operation mode. The first ejection time and the second ejection time described above satisfy these needs.

FIG. 7 shows a method of computing the actual transition observation time. A horizontal axis shows the time axis. (A) shows a designated transition observation time ta. (B) shows a storage time tb and an ejection time tc. In the embodiment, the storage time tb is indirectly specified as a result of selection of the operation mode. The ejection time tc is a fixed value. (C) shows a storage-ejection time td. Here, td=tb+tc. (D) shows an actual transition observation time te.

When the transition observation time ta is divided by the storage-ejection time td, a quotient which is composed of an integer quotient n and a remainder 66 is computed. The remainder 66 is a numerical value which is the fraction part, and is truncated. The integer quotient n is used as a number of repetitions n. By a computation of (storage-ejection time td)×(the number of repetitions n), the actual transition observation time te is computed. The actual transition observation time te is shorter than the transition observation time ta by a time shown by reference numeral 68. When the transition observation time ta is used as is, a wasteful idle time would be caused in the operation of the collision cell, corresponding to the time shown by reference numeral 68. In the contrary, according to the first scheme, because the operation of the measurement unit can be controlled based on the actual transition observation time te, the wasteful idle time is not caused in the collision cell.

The actual transition observation time te is determined as a time of an integer multiple (n times) of the storage-ejection time such that the number of the storing operations of the collision cell is the largest within the frame of the transition observation time ta. Because the actual transition observation time te is normally a time close to the transition observation time ta, the employment of the actual transition observation time te does not significantly deviate from the user's designation or intention. While it is technically possible to set the actual transition observation time te to be longer than the transition observation time ta, as such a configuration would increase the sampling period and would also increase a possibility that a peak of a compound cannot be accurately observed. Therefore, desirably, the actual transition observation time to is set to be less than or equal to the transition observation time ta.

Figure 8:
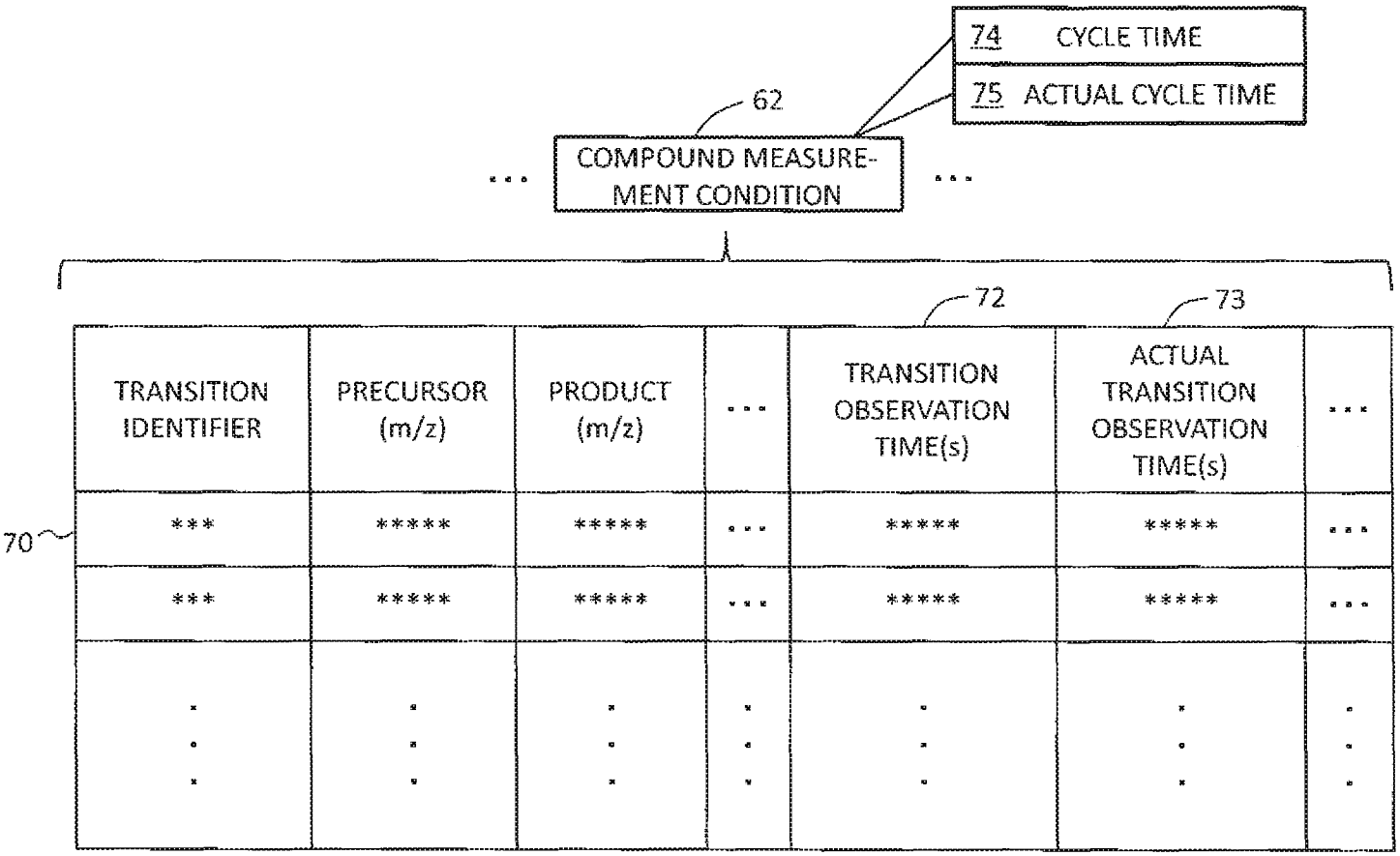
FIG. 8 is a diagram showing a compound measurement condition including an actual transition observation time.

In the first scheme, for example, as shown in FIG. 8, the individual compound measurement condition is managed. A parameter set 70 includes, in addition to a transition observation time 72, an actual transition observation time 73. The compound measurement condition 62 includes, along with a cycle time 74, an actual cycle time 75. The actual cycle time is a sum of a plurality of actual transition observation times corresponding to a plurality of transitions of the cycle unit, and corresponds to the actual sampling period. As shown by S14 in FIG. 5, the actual transition observation time 73 and/or the actual cycle time are presented to the user prior to the actual sample measurement. With this process, it becomes possible for the user to recognize a precise operation condition.

(3) Second Scheme (Storage-Ejection Time Optimization Scheme)

Next, with reference to FIGS. 9 to 11, the second scheme will be described. In a first example configuration of the second scheme shown in FIG. 9, the storage-ejection time is optimized for each transition, and the storage time is optimized for each transition based on the optimized storage-ejection time. In a second example configuration of the second scheme to be described later with reference to FIG. 11, the storage time is optimized for each compound measurement.

For increasing the sensitivity, it is desirable to store the ions in the collision cell to a maximum degree. A maximum storage time in the collision cell is a maximum time in which the ions can be stored in the collision cell, and is determined by an acceptable amount of the collision cell (ion accommodation capability) and an amount of flowing-in ions. The acceptable amount can be estimated to a certain degree based on the structure of the collision cell, but the ion flow-in amount varies among measurements. Thus, a maximum ion flow-in amount is anticipated, and a maximum storage time is specified in advance based on the anticipated maximum ion flow-in amount and the acceptable amount.

Figure 9:
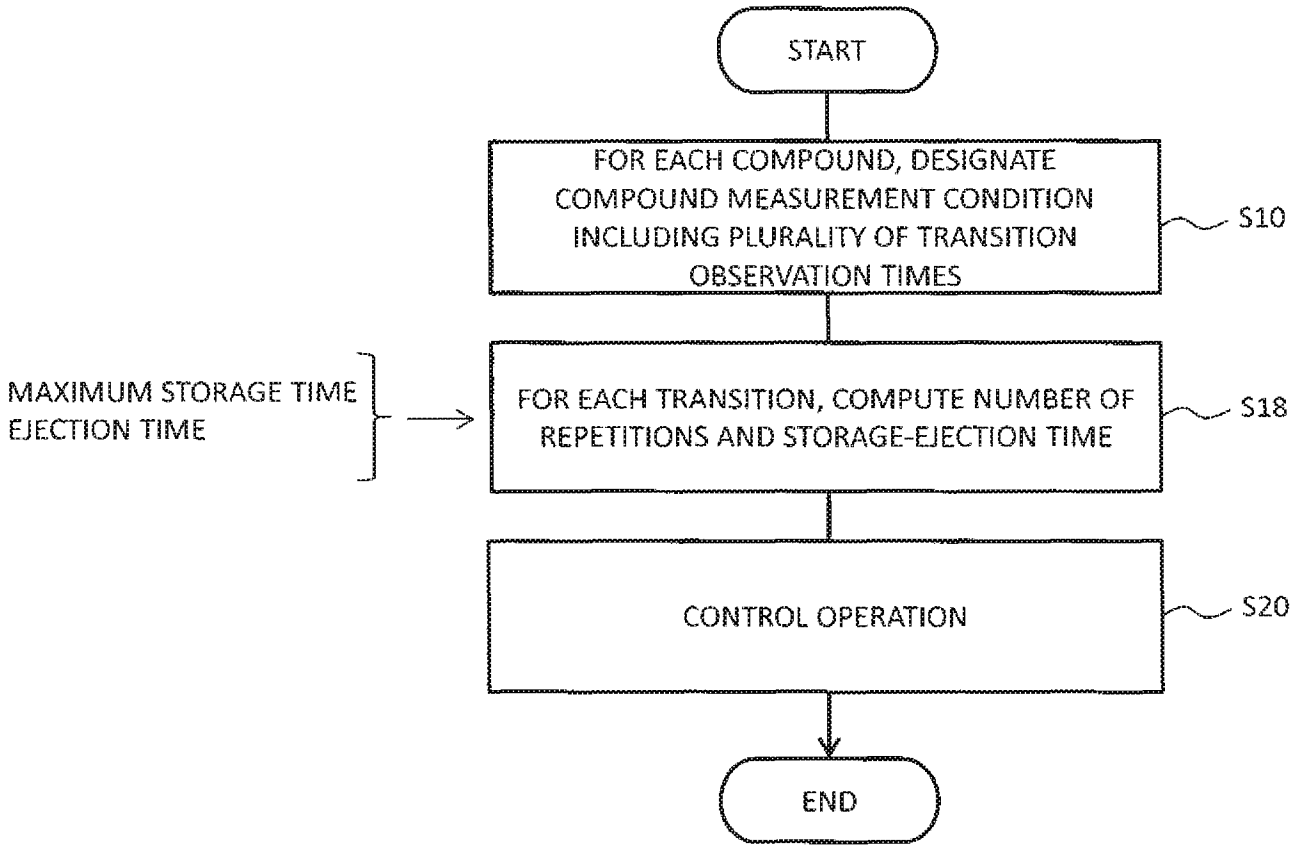
FIG. 9 is a flowchart showing a first example configuration of a storage-ejection time optimization scheme.

FIG. 9 shows the first example configuration of the second scheme. In S10, a compound measurement condition is designated for each compound. Each compound measurement condition includes a plurality of transition observation times corresponding to a plurality of transitions. In S18, based on the maximum storage time and the ejection time, a number of repetitions of the storing-ejecting operation is computed for each transition, and the storage-ejection time is computed. In addition, the storage time is computed based on the storage-ejection time for each transition. A plurality of parameters thus computed are incorporated into a part of the compound measurement condition. In S20, the operation of the measurement unit is controlled based on the plurality of compound measurement conditions.

Figure 10:
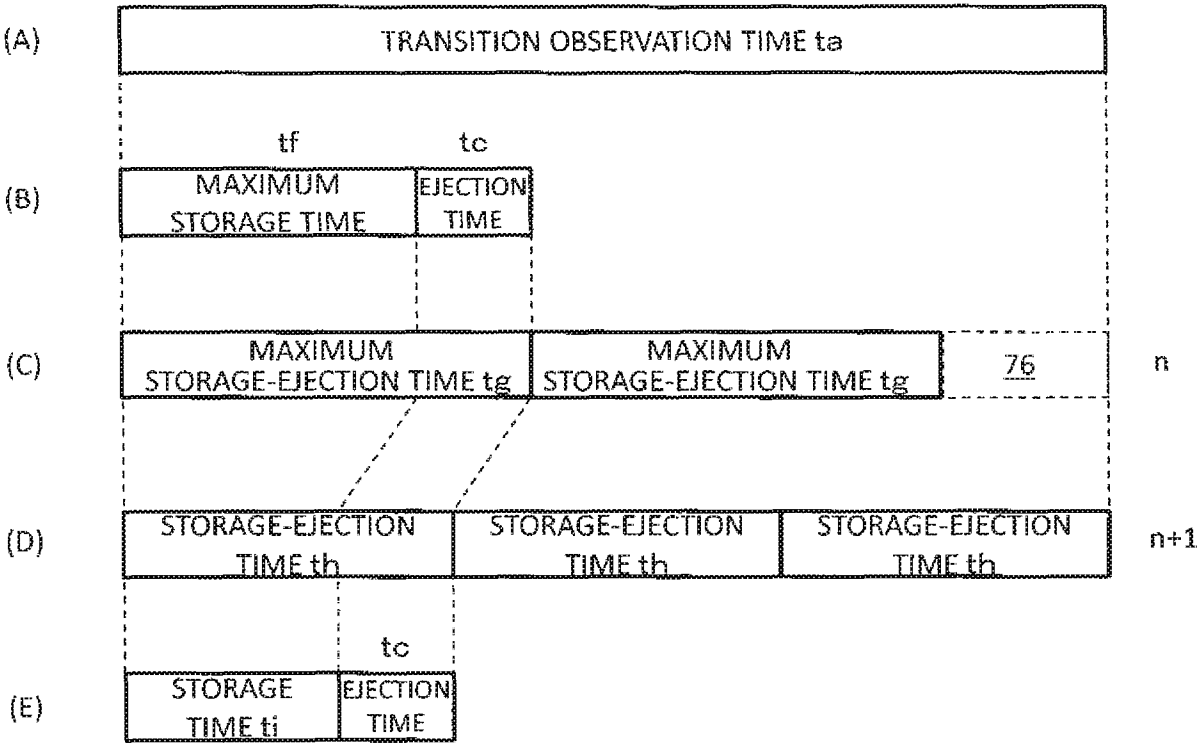
FIG. 10 is a diagram for explaining computation of a storage time.

FIG. 10 shows a method of computing the storage time. A horizontal axis is a time axis. (A) shows a designated transition observation time ta. (B) shows the maximum storage time tf and the ejection time tc. The maximum storage time tf and the ejection time tc are set in advance. (C) shows the maximum storage-ejection time tg. Here, tg=tf+tc. (D) shows the storage-ejection time th. (E) shows the storage time ti and the ejection time tc. Here, th=ti+tc.

By dividing the transition observation time ta by the maximum storage-ejection time tg, a quotient which is composed of an integer quotient n and a remainder 76 is computed. The remainder 76 is the fraction part, and is rounded up. That is, when the remainder 76 occurs, the number of repetitions of the storing-ejecting operation is determined as n+1. By dividing the transition observation time ta by the number of repetitions n+1, the storage-ejection time th is computed. In the example shown in the drawing, the transition observation time ta is equally divided into three storage-ejection times th. By subtracting the ejection time tc from the storage-ejection time th, the storage time ti is computed. Assuming that the transition observation time ta is determined for each transition, the storage-ejection time th (in particular, the storage time ti) is optimized for each transition. At the same time, the storage time ti is optimized for each transition. When the remainder 76 does not occur, the number of repetitions of the storing-ejecting operation is n, and the storage-ejection time th is equal to the maximum storage-ejection time tg.

In the second scheme, all of the transition observation time ta can be used without waste. As a result, the storage time can be set to a time within the maximum storage time, and the problem of the ion loss in the collision cell can be avoided or reduced. In addition, because the storage time is set to a time close to the maximum storage time, the sensitivity can be improved. Theoretically, the storage-ejection time th may be determined by dividing the transition observation time ta by n+2 or the like, in place of n+1.

Figure 11:
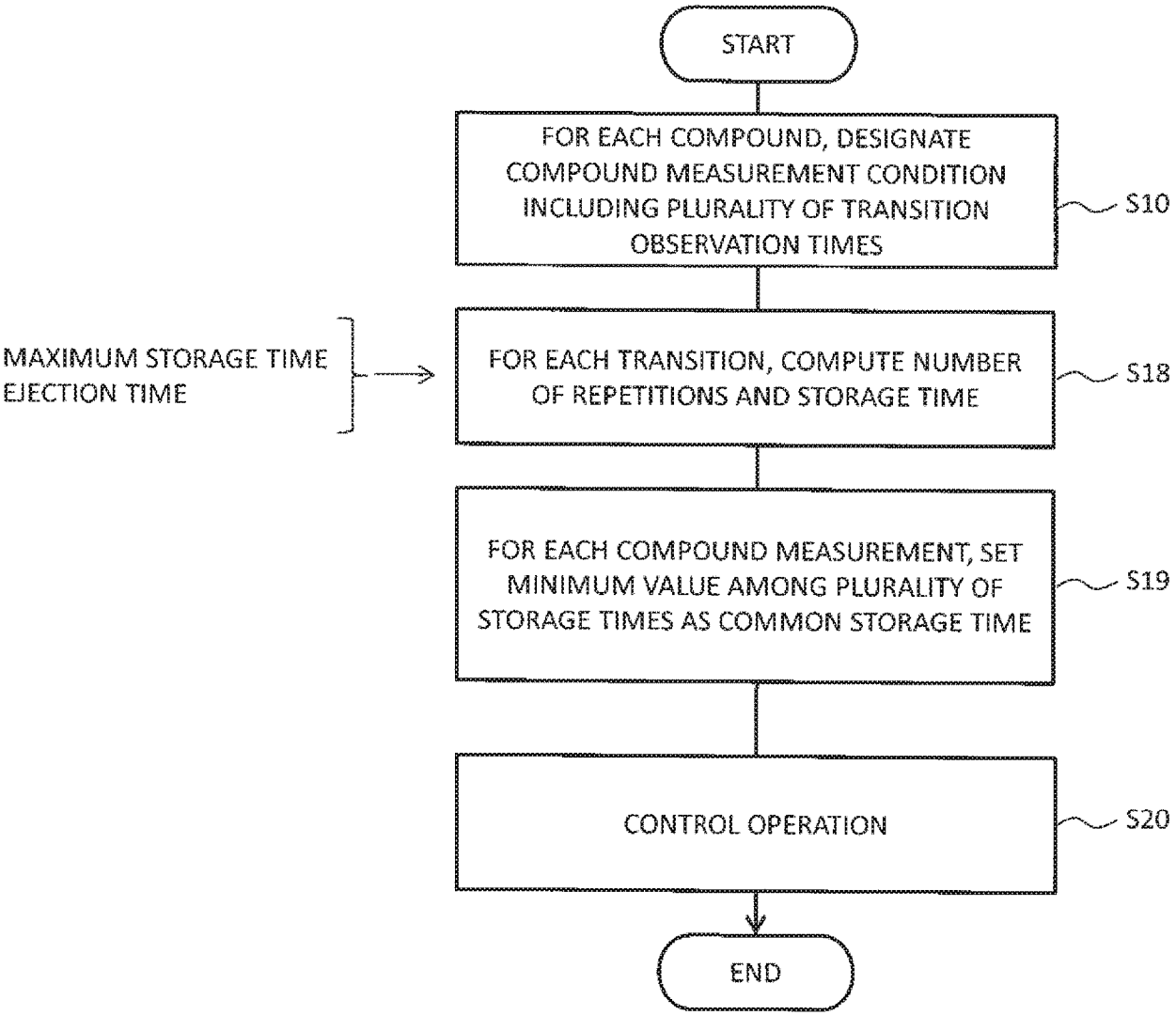
FIG. 11 is a flowchart showing a second example configuration of the storage-ejection time optimization scheme.

FIG. 11 shows the second example configuration of the second scheme. S10 and S18 have already been described with reference to FIG. 9. In S19, in each compound measurement condition, the shortest storage time among a plurality of storage times determined for the plurality of transitions of the compound measurement condition is specified, and is set as a common storage time in the compound measurement. In S20, sample measurement is executed according to the compound measurement condition determined for each compound.

When the above-described first example configuration is employed, the storage-ejection time (in particular, the storage time) can be optimized for each transition, and, consequently, the sensitivity can be further improved. On the other hand, the control becomes complex. According to the second example configuration, because the storage-ejection time (in particular, the storage time) can be maintained in units of compounds, the control can consequently be simplified.

In either case of employing the first scheme (transition observation time optimization scheme) or employing the second scheme (storage-ejection time optimization scheme), the transition observation time and the storage-ejection time can be rationally correlated with each other in the operation control of the measurement unit.

In the mass analysis apparatus, the first scheme or the second scheme may be employed as a single scheme, or in the mass analysis apparatus, both the first scheme and the second scheme may be employed. In this case, one of the schemes is selected according to a user's selection, or automatically based on predetermined standards.

(4) Mass Analysis Apparatus Having Temperature Management Function

Figure 12:
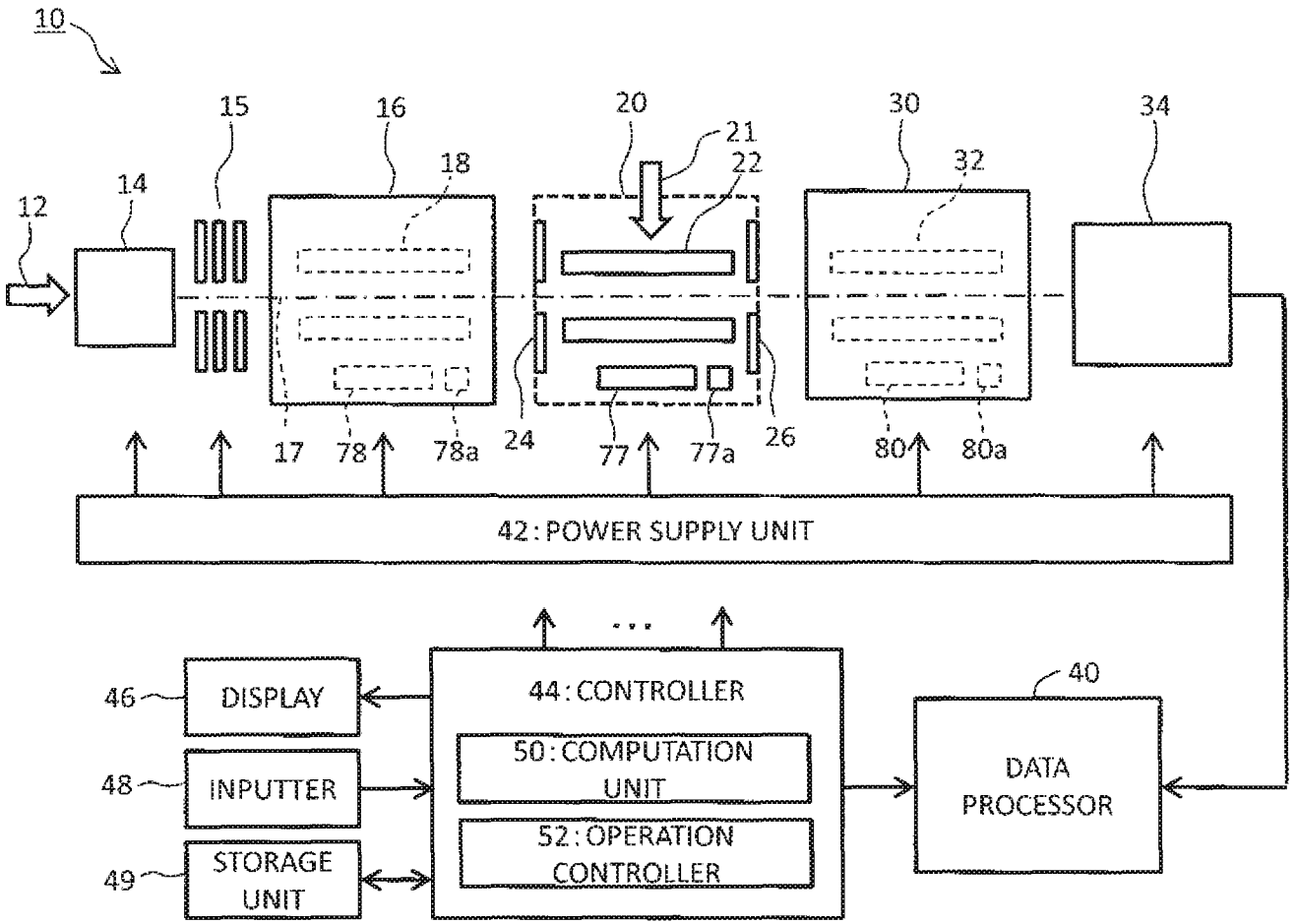
FIG. 12 is a block diagram showing a mass analysis system having a temperature management function.

FIG. 12 shows a mass analyzer having a temperature management function. In FIG. 12, structures similar to the structures shown in FIG. 1 are assigned the same reference numerals, and will not be described again.

In FIG. 12, when contamination occurs inside the collision cell 20, charging or sensitivity reduction may occur. Thus, in order to maintain the inside of the collision cell 20 in a clean state, a heater 77 is provided inside the collision cell 20. Specifically, the heater 77 heats four poles which are the ion guide 22, to manipulate the temperatures thereof. The heater 77 is formed from, for example, a plurality of heater components. A temperature sensor 77*a* is provided for detecting an inside temperature of the collision cell 20.

The controller 44 periodically reads a detected temperature detected by the temperature sensor 77*a*. The controller 44 functions as a temperature management means, and allows start of measurement when the temperature of the collision cell 20 becomes a predetermined value or higher, when the temperature becomes a temperature in a predetermined range, or when a condition designated by the user is satisfied. If a setting temperature for the collision cell 20 is set unnecessarily high even though the storage time is short, a long time would be required for heating or cooling, which consequently would cause elongation of a down time in the measurement process. In consideration of this, the setting temperature may be switched according to the storage time, as shown in a table 84 of FIG. 13. For example, a control may be applied in which the setting temperature is increased corresponding to an increase in the storage time.

In FIG. 12, a heater 78 and a temperature sensor 78*a* are also provided for the first mass analyzer 16, and a heater 80 and a temperature sensor 80*a* are provided for the second mass analyzer 30. With this configuration, it is possible to maintain the insides of the first mass analyzer 16 and the second mass analyzer 30 in the clean state. Alternatively, the structure for heating and managing the temperature shown in FIG. 12 may be applied to a mass analysis apparatus which is not provided with the above-described first scheme or the above-described second scheme.

The invention claimed is:

1. A mass analysis apparatus comprising:

a measurement unit comprising a first mass analyzer which selects first target ions from among precursor ions, a collision cell which generates product ions from the first target ions and which stores and ejects the product ions, a second mass analyzer which selects second target ions from among the product ions, and a detector which detects the second target ions;

an inputter for designating a transition observation time for each of transitions which are combinations of the first target ions and the second target ions;

a computation unit that computes, for each of the transitions, an actual transition observation time as a time of an integer multiple of a storage-ejection time which is a sum of a storage time and an ejection time of the collision cell such that a storing-ejecting operation of the collision cell is repeated a largest number of times within a frame of the transition observation time; and an operation controller that controls an operation of the measurement unit based on the storage time and the ejection time of the collision cell, and the actual transition observation time for each of the transitions.

2. The mass analysis apparatus according to claim 1, wherein the computation unit:

computes a quotient by dividing the transition observation time by the storage-ejection time;

computes a number of repetitions of the storing-ejecting operation by truncating fractions of the quotient; and computes the actual transition observation time by multiplying the storage-ejection time by the number of repetitions.

3. The mass analysis apparatus according to claim 1, wherein a plurality of storage times and a plurality of ejection times corresponding to a plurality of modes are managed, a particular mode is selected from among the plurality of modes using the inputter, and the computation unit computes the actual transition observation time based on the storage time and the ejection time corresponding to the particular mode.

4. The mass analysis apparatus according to claim 1, further comprising:

a display that displays the actual transition observation time for each of the transitions or displays an actual cycle time which is a sum of a plurality of the actual transition observation times corresponding to a plurality of the transitions.

5. A mass analysis method comprising:

selecting, in a first mass analyzer, first target ions from among precursor ions;

generating, in a collision cell, product ions from the first target ions, and storing and ejecting the product ions;

selecting, in a second mass analyzer, second target ions from among the product ions;

receiving a designation of a transition observation time for each of transitions which are combinations of the first target ions and the second target ions;

computing, for each of the transitions, an actual transition observation time as a time of an integer multiple of a storage-ejection time which is a sum of a storage time and an ejection time of the collision cell such that a storing-ejecting operation of the collision cell is repeated the largest number of times within a frame of the transition observation time; and controlling operations of the first mass analyzer, the collision cell, and the second mass analyzer based on the storage time and the ejection time of the collision cell, and the actual transition observation time for each of the transitions.

* * * * *